United States Patent [19]

Houng

[11] Patent Number: 5,007,510

[45] Date of Patent: Apr. 16, 1991

[54] FRAME ASSEMBLY FOR CASE OR SIMILAR ARTICLE

[76] Inventor: Vichai Houng, No. 198-200, Sec. 1, Kang Ning Rd., Taipei, Taiwan

[21] Appl. No.: 558,281

[22] Filed: Jul. 26, 1990

[51] Int. Cl.[5] ..... A45C 13/04

[52] U.S. Cl. ..... 190/122; 220/668

[58] Field of Search ..... 220/668, 669, 682, 689, 220/611, 615; 190/122, 107

[56] References Cited

U.S. PATENT DOCUMENTS

| | | | |
|---|---|---|---|
| 3,677,433 | 7/1972 | Collins | 220/668 |
| 4,176,734 | 12/1979 | Wang | 190/122 |
| 4,693,346 | 3/1987 | Eversdijk | 190/122 |
| 4,744,445 | 5/1988 | Anderson et al. | 220/668 |
| 4,771,908 | 9/1988 | McIntosh | 220/668 |
| 4,823,924 | 4/1989 | Goodin | 190/122 |
| 4,823,972 | 4/1989 | Ressler et al. | 220/668 |
| 4,905,822 | 3/1990 | Bosco | 220/668 |

*Primary Examiner*—Joseph Man-Fu Moy

*Attorney, Agent, or Firm*—Connolly & Hutz

[57] ABSTRACT

A frame assembly for a case or similar article comprising a first and a second frames each being a one-piece structure and being different from each other only in their mutual engagement part so that the first frame is hinged to the second frame with side walls and corner pieces incorporated therein to complete a case. Each frame comprises side portions connected to each other by a brace piece thus forming corner openings for receiving the corner pieces. Each frame has adjacent ends which are so arranged that the contacting line of the two ends is covered by the hinge mechanism and unseen from the outside.

4 Claims, 3 Drawing Sheets

FRAME ASSEMBLY FOR CASE OR SIMILAR ARTICLE

BACKGROUND OF THE INVENTION

The present invention relates generally to a body or frame for a detachable case or other similar article. More particularly, the present invention relates to a frame assembly which comprises a first and second one-piece frame that is easy to manufacture and assemble.

In the past, detachable suitcases and briefcases were made of too many pieces to be manufactured economically. A type of the detachable case is disclosed in U.S. Pat. No. 4,770,312, issued Sept. 13, 1988. Although the detachable case disclosed in that patent overcomes many of the limitations of the prior art, additional improvements have now been made thereto.

SUMMARY OF THE INVENTION

The invention substantially comprises a first and a second frame having respective corner openings thereon, respective corner piece to be inserted into the corner opening of each frame, and hinge means for coupling the first frame to the second frame. Each frame is a one-piece design made from any suitable material, like aluminum, which can be shaped or bent to maintain a desired shape. In the embodiment of the present invention, in order to select the position of the contacting line of the adjacent ends of the frame which might affect the appearance of the case, the adjacent ends of each frame are preferably arranged in such position that the contacting line can not be seen from outside after the frames are assembled and used in the construction of a case or similar article.

Accordingly, it is an object of this invention to provide a frame assembly for a case or similar article comprising first and second frames which are suitably formed of a one-piece construction and can be easily manufactured and assembled or disassembled.

A further object of this invention is to provide a frame assembly for case or similar article which has a minimum of components; each one easy to manufacture individually.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
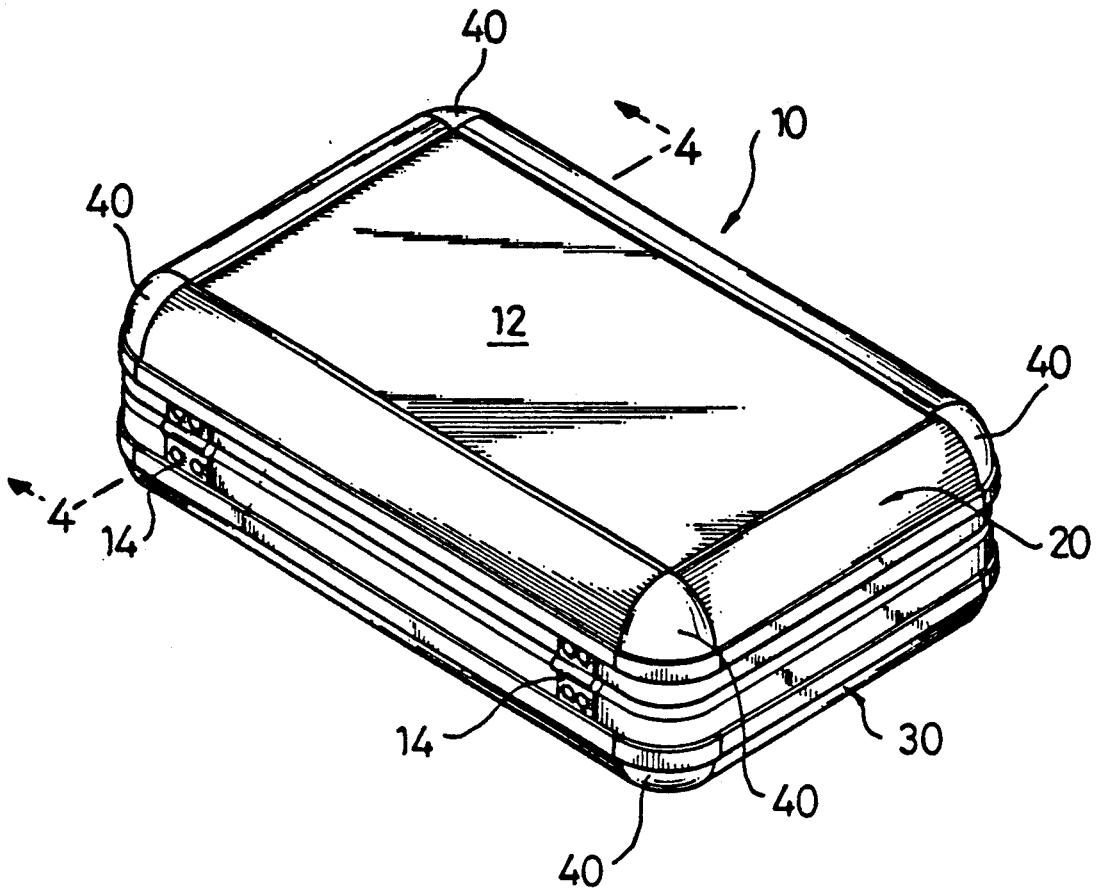
FIG. 1 is a perspective view of a case incorporating the frame assembly of the invention.
Figure 2:
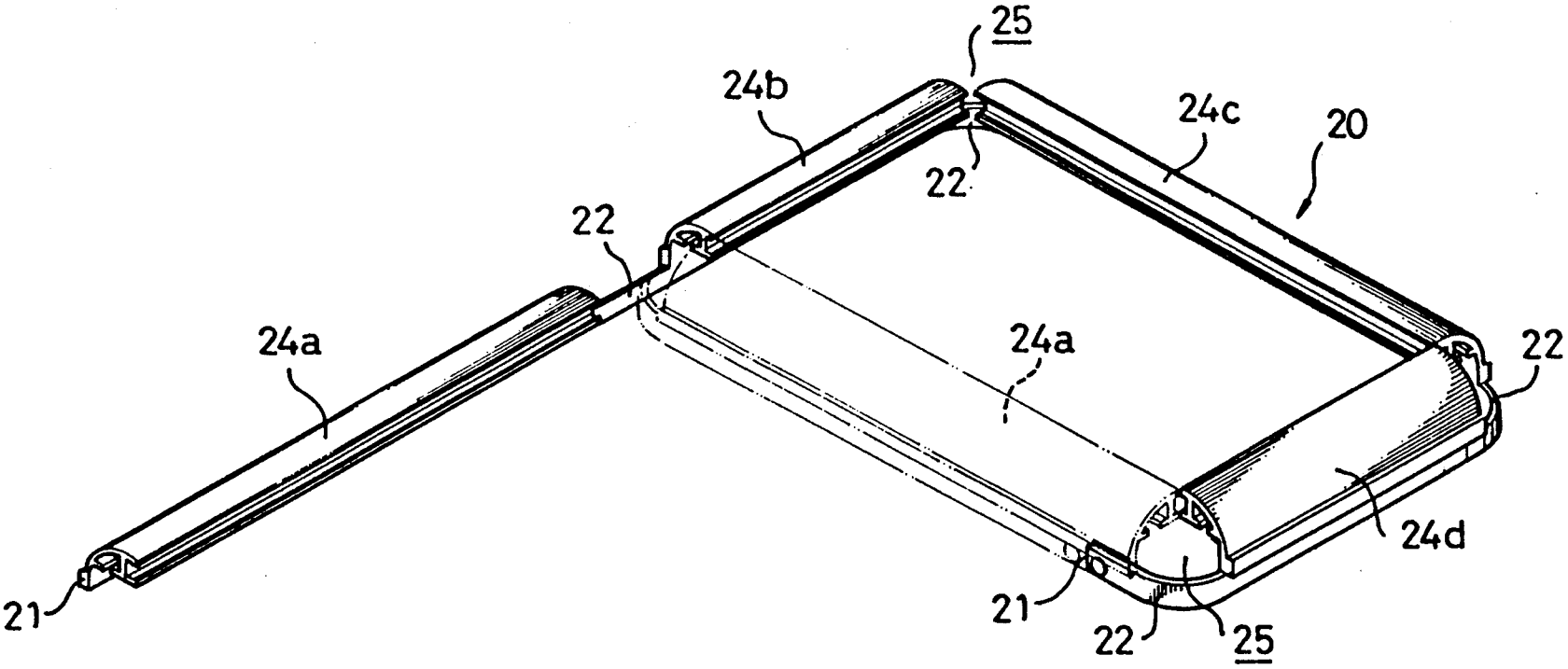
FIG. 2 is a perspective view of a frame in accordance with the invention.

Referring to the drawings, and more particularly to FIGS. 1 and 2, there is shown the frame assembly, generally designated by reference number 10, which incorporates the preferred embodiment of the present invention. Although the frame assembly 10 illustrates specific conventional elements like the wall 12 and hinges 14, it is within the scope of the invention to suitably utilize known elements to construct the novel frame assembly 10 in accordance with the invention.

The frame assembly 10 comprises a first frame 20, a second frame 30 coupled to the first frame 20 by hinge means 14 in a known manner, and a plurality of corner pieces 40 on respective corners of the first and second frames 20 and 30. Both the first and second frames 20 and 30 are made of a one-piece construction (cf. FIG. 2). Each one-piece frame, such as the first frame 20 shown in FIG. 2, is curved or bent on its brace portions 22 from a linear construction to form the configuration as shown in FIG. 1. Since both frames 20 and 30 are of the same design and construction except for the portion where the first frame 20 is in engagement with the second frame 30, it is sufficient to describe one of the two frames hereinbelow but not both.

The first frame 20 in the present embodiment is composed of four side portions 24*a*, 24*b*, 24*c* and 24*d*, as can be seen in FIG. 2, with the side portion 24*a* shown to be in line with the side portion 24*b* to particularly illustrate the configuration of each frame before it is bent to a closed loop shape as shown by dotted line in FIG. 2. The frame 20 has two free ends which will be proximate to or in contact with each other when the frame is closed to form a loop. The side portions 24*a*–24*d* are each connected to an adjacent one by the curved brace portion 22. Two adjacent side portions 24*a* and 24*d*, for example, and one corresponding curved brace portion 22 therebetween define a corner opening 25 for receiving a corner piece 40.

Figure 4:
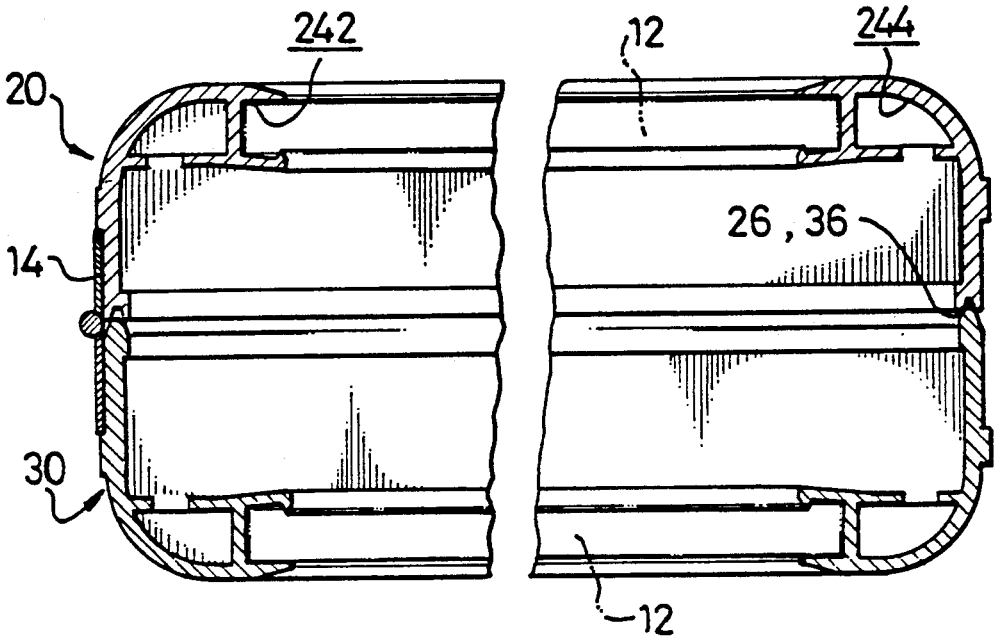
FIG. 4 is a cross-sectional view of the frame assembly of FIG. 1 taken along line 4—4.

As can be seen from FIGS. 2 and 4, the first frame 20 comprises a first peripheral groove 242 extending along an inside wall of each side portion adapted for receiving a flat side wall 12. As mentioned above, what makes the first frame 20 different from the second frame 30 is that the first frame 20 has an engagement groove 26 which is engageable with a tapered projection 36 formed on the second frame 30. A pair of known hinge means 14 are fixedly attached to peripheral walls of the first and second frame 20 and 30 so that the first frame 20 is pivotal relative to the second frame 30.

FIG. 2 clearly shows that the side piece 24*a* has an end 21 which corresponds to one of the adjacent ends of the first frame 20. Another end 21 extending from the brace portion 22 which connects to the side portion 24*d* matches a part of the side portion 24*a*. As described above, the adjacent ends 21 are arranged in such position that the contacting line is covered and unseen from outside. In this embodiment, the hinge means 14 which attaches to the frames 20 and 30 serves this purpose.

Figure 3:
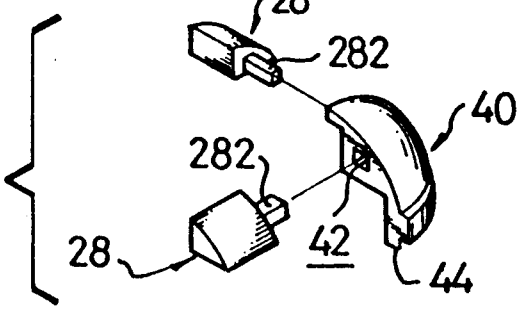
FIG. 3 is a perspective view schematically showing one corner piece and two receiving pieces.

Referring now to FIG. 3, the corner piece 40 and corresponding receiving pieces 28 are shown. The corner piece 40, to be inserted into the corner opening 25 formed between two adjacent side portions, comprises a hole 42 on the surface facing the pair of receiving pieces 28. The receiving piece 28, which can be frictionally engaged into an intermediate groove 244 extending along an inside wall of each side portion, comprises a tenon 282 having a complementary size and shape and size to the hole 42 of the corner piece 40 so that the corner piece 40 is frictionally receivable into the corner opening 25 by the hole and tenon engagement.

As is known to this art, the corner piece 40 has a shape which securely fits into the corner opening 25 so that there is not any undesired recess or gap formed between the corner piece 40 and corresponding side portions. For example, the corner piece 40 may be provided with a flange 44 for resting on the brace piece 22 when the corner piece 40 is inserted into the corner opening 25. Also, the outer shape of the corner piece 40 is conformable with the outside surface of the side portions 24*a*–24*d* so as not to affect its appearance.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A frame assembly for a case or similar article comprising:

a first and a second one-piece frame each forming a closed loop and having adjacent ends, said first and second frames each being composed of a plurality of side portions interconnected by a respective curved brace portion, two said side portions and said one corresponding curved brace portion defining a corner opening, each frame having a first peripheral groove extending along an inside wall of each side portion adapted for receiving a side wall, said first frame comprising an engagement groove engageable with a tapered projection of said second frame;

a plurality of corner pieces each insertable into a corresponding corner opening of each frame; and hinge means being disposed on a respective outer wall of said first and second frames so that said first and second frames are hingedly pivotal with respect to each other.

2. A frame assembly as claimed in claim 1, wherein one of the said adjacent ends of each frame has a portion corresponding to an end of one said side portion, and the other of said ends of each frame is covered by said hinge means so as to be invisible from the outside.

3. A frame as claimed in claim 1, wherein each frame assembly comprises an intermediate groove extending along an inside wall of each side portion for receiving a pair of receiving pieces at opposite ends of each said side portion, each receiving piece having a tenon which is engageable with a corresponding hole provided on said corner piece for holding said corner piece in place.

4. A frame assembly as claimed in claim 1, wherein said first and second frame are substantially rectangular-shaped.

* * * * *